US009745672B2

(12) United States Patent
Schmid et al.

(10) Patent No.: US 9,745,672 B2
(45) Date of Patent: Aug. 29, 2017

(54) BALE OPENER

(71) Applicant: Maschinenfabrik Rieter AG, Winterthur (CH)

(72) Inventors: Alexander Schmid, Winterthur (CH); Gerhard Gschliesser, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 7 days.

(21) Appl. No.: 14/884,868

(22) Filed: Oct. 16, 2015

(65) Prior Publication Data

US 2016/0108558 A1 Apr. 21, 2016

(30) Foreign Application Priority Data

Oct. 16, 2014 (CH) ..... 1582/14

(51) Int. Cl.

| | |
|---|---|
| ***A01G 7/04*** | (2006.01) |
| ***D01G 7/04*** | (2006.01) |
| ***D01G 7/10*** | (2006.01) |
| ***D01G 7/14*** | (2006.01) |

(52) U.S. Cl.

CPC ..... *D01G 7/04* (2013.01); *D01G 7/10* (2013.01); *D01G 7/14* (2013.01)

(58) Field of Classification Search

CPC .. D01G 7/00; D01G 7/02; D01G 7/04; D01G 7/06; D01G 7/08; D01G 7/10; D01G 7/12; D01G 7/14

USPC ..... 19/82–83, 80 R

See application file for complete search history.

(56) References Cited

U.S. PATENT DOCUMENTS

| | | | | | |
|---|---|---|---|---|---|
| 3,443,285 | A * | 5/1969 | Goldammer | D01G 7/00 | 19/81 |
| 4,000,541 | A * | 1/1977 | Marzoli | D01G 13/00 | 19/145.5 |
| 4,107,820 | A * | 8/1978 | Mahrt | D01G 13/00 | 19/145.5 |
| 4,259,765 | A * | 4/1981 | Trutzschler | D01G 7/06 | 100/269.04 |
| 4,297,766 | A * | 11/1981 | Trutzschler | D01G 13/00 | 19/145.5 |
| 4,363,585 | A * | 12/1982 | Keller | D01G 7/10 | 19/145.5 |

(Continued)

FOREIGN PATENT DOCUMENTS

| | | | | |
|---|---|---|---|---|
| AT | WO 2009062325 A1 * | 5/2009 | | D01G 7/04 |
| CN | 202323189 U | 7/2012 | | |

(Continued)

OTHER PUBLICATIONS

Swiss Patent Office Search Report, dated Dec. 9, 2014.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A bale opener for stripping fiber flocks from fiber bales, including a stripping tower arranged on a running gear or a bogie and having a stripping arm. The stripping arm is mounted in a height-adjustable mount in a guide on the stripping tower. A lifting gear is provided for the height adjustment of the stripping arm, wherein the lifting gear is mounted on the stripping arm and on the stripping tower, and the lifting gear has at least one load cell.

8 Claims, 3 Drawing Sheets

(56) References Cited

U.S. PATENT DOCUMENTS 4,382,316 A * 5/1983 Goldammer ..... D01G 13/00 19/145.5
4,446,602 A * 5/1984 Marx ..... D01G 31/00 19/0.21
4,455,714 A * 6/1984 Goldammer ..... D01G 13/00 19/145.5
4,467,502 A 8/1984 Lytton et al.
4,475,270 A * 10/1984 Hergeth ..... D01G 7/10 19/81
4,493,131 A * 1/1985 Dragagna ..... D01G 7/14 19/145.5
4,503,798 A * 3/1985 Hergeth ..... D01G 7/10 414/730
4,507,826 A * 4/1985 Keller ..... D01G 7/04 19/80 R
4,514,881 A * 5/1985 Hergeth ..... D01G 7/10 19/80 R
4,554,708 A * 11/1985 Leifeld ..... D01G 7/06 19/66 CC
4,595,149 A * 6/1986 Hergeth ..... D01G 7/10 19/80 R
4,660,257 A * 4/1987 Binder ..... D01G 7/10 19/300
4,678,128 A * 7/1987 Hergeth ..... D01G 7/04 104/161
4,707,888 A 11/1987 Binder et al.
4,715,722 A * 12/1987 Hergeth ..... D01G 13/00 366/132
4,750,240 A * 6/1988 Temburg ..... D01G 7/12 19/80 R
4,774,758 A * 10/1988 Pinto ..... D01G 7/06 241/37
4,785,504 A * 11/1988 Leifeld ..... D01G 7/04 19/80 R
4,796,334 A * 1/1989 Yecheskel ..... D01H 5/22 19/0.27
4,845,812 A * 7/1989 Kriechbaum ..... B08B 15/005 19/80 R
4,884,319 A * 12/1989 Schmidt ..... D01G 7/14 19/80 R
4,893,757 A * 1/1990 Weder ..... D01G 7/10 19/80 R
4,912,811 A * 4/1990 Walk ..... D01G 7/10 15/312.1
4,993,119 A * 2/1991 Roberson ..... D01G 13/00 19/105
4,995,142 A * 2/1991 Binder ..... D01G 7/10 19/80 R
5,011,511 A 4/1991 Beck
5,079,800 A * 1/1992 Leifeld ..... D01G 7/14 19/80 R
5,090,090 A * 2/1992 Temburg ..... D01G 7/10 19/80 R
5,093,961 A * 3/1992 Temburg ..... D01G 7/10 19/145.5
5,105,507 A * 4/1992 Staheli ..... D01G 7/10 19/80 R
5,121,418 A * 6/1992 Staheli ..... D01G 7/10 377/24.1
5,133,110 A * 7/1992 Temburg ..... D01G 7/10 19/145.5
5,175,909 A * 1/1993 Pinto ..... D01G 7/12 19/80 R
5,189,308 A * 2/1993 Kortlang ..... D01G 7/10 19/80 R
5,282,141 A * 1/1994 Faas ..... D01G 13/00 19/105
5,285,552 A 2/1994 Leifeld et al.
5,323,513 A * 6/1994 Binder ..... D01G 31/00 19/65 A
5,328,016 A * 7/1994 Leifeld ..... D01G 7/06 19/80 R
5,367,748 A * 11/1994 Leifeld ..... D01G 7/10 19/80 R
5,495,642 A * 3/1996 Trutzschler ..... D01G 7/14 19/80 R
5,515,577 A * 5/1996 Pinto ..... D01G 13/00 19/80 R
5,564,165 A * 10/1996 Zander ..... D01G 7/14 19/80 R
5,768,750 A * 6/1998 Williams ..... D01G 13/00 19/80 R
5,917,591 A * 6/1999 Schlichter ..... D01G 7/10 19/80 R
5,933,921 A * 8/1999 Jossi ..... D01B 3/025 19/200
6,056,429 A * 5/2000 Duggan ..... A23G 4/02 366/148
6,170,341 B1 * 1/2001 Avitan ..... B66F 17/003 73/862.392
6,497,008 B1 * 12/2002 Schlepfer ..... D01G 7/10 19/145.5
6,524,442 B2 * 2/2003 Tanner ..... D21B 1/066 162/261
7,506,410 B2 * 3/2009 Minter ..... D01G 7/06 19/105
7,513,016 B2 * 4/2009 Hergeth ..... D01G 7/08 19/80 R
8,539,878 B2 * 9/2013 Verhaeghe ..... A01F 15/0825 100/35
9,297,688 B2 * 3/2016 Posselius ..... A01F 15/0833
2015/0025757 A1 * 1/2015 Dumarey ..... A01F 15/046 701/50
2016/0108559 A1 * 4/2016 Schmid ..... D01G 7/14 19/80 R
2016/0165801 A1 * 6/2016 Posselius ..... A01F 15/0833 56/341

FOREIGN PATENT DOCUMENTS

EP 2 322 701 A1 5/2011
GB 1 431 365 4/1976
WO WO 20091062325 A 5/2009

* cited by examiner

BALE OPENER

FIELD OF THE INVENTION

The invention relates to a bale opener for stripping fiber flocks from fiber bales using a stripping tower arranged on a running gear or a bogie and using a stripping arm.

BACKGROUND

Bale stripping machines or bale openers are used to release fibers or fiber flocks from pressed fiber bales. To do so, a stripping element is moved over the fiber bales. The stripping element is mounted on a stripping arm, which is adjusted in height on the present fiber bales. The stripping arm is in turn held on a stripping tower. The stripping tower makes it possible for the stripping element to be movable over the surface of the fiber bales to be stripped. The stripping arm is arranged on a running gear or a bogie. With a running gear, which is usually guided on rails, it is possible to move along a row of bales. If the fiber bales are arranged in a circle around the stripping tower, the stripping tower is arranged on a bogie. A combination of a running gear and a bogie is used when fibers or fiber flocks are stripped from a first row of fiber bales in one direction and then from a second row of fiber bales in the opposite direction.

The bale opener stands at the beginning of process lines in preparation for a spinning mill (opening room) for processing fiber materials, for example, cotton or synthetic fibers or mixtures thereof, and has a crucial influence on the continuity of the processes inside the spinning mill preparation. In the bale opener, the fiber materials supplied in bales are released from the bales by stripping off the fiber flocks and then transferred to a pneumatic transport system. The pneumatic transport system takes the fiber flocks through pipelines to the downstream cleaning machines.

In the bale openers conventionally used today, the stripping arm is mounted in a height-adjustable mount on the stripping tower. The height adjustment usually takes place by means of chain or belt drives on which the stripping arm is raised or lowered. To determine the position of the stripping arm in relation to the surface of the fiber bales, sensors are provided on the stripping arm.

Various embodiments of lifting gear for stripping arms are known from the prior art. For example, CH 686 188 A5 discloses a stripping arm with a chain drive for the height adjustment. The stripping arm is suspended by a cable and pulleys on a counterweight, wherein the stripping arm is adjustable in height with a lifting motor by means of a chain drive.

CH 675 386 A discloses a bale opener which moves the stripping arm in a circular pattern over the fiber bales to be opened. The stripping arm is adjusted in height by means of four threaded rods arranged at the corners. The stripping arm is raised or lowered by rotating the threaded rods simultaneously. The threaded rods are connected by a gear to ensure a synchronized movement of the threaded rods.

One disadvantage of the known design according to the prior art is the complex sensor system which is necessary for detection, adjustment and the operationally required adjustment of the position of the stripping arm.

SUMMARY OF THE INVENTION

An object of the invention is to create a bale opener having a stripping arm, which permits an easily controllable height adjustment and positioning of the stripping arm.

Additional objects and advantages of the invention will be set forth in part in the following description, or may be obvious from the description, or may be learned through practice of the invention.

To achieve the objects, a force-dependent height adjustment of the stripping arm is proposed. The bale opener for stripping fiber flocks from fiber bales comprises a stripping tower arranged on a running gear or a bogie and a stripping arm, wherein the stripping arm is held in a guide on the stripping tower so that it is adjustable in height. For the height adjustment of the stripping arm, a lifting gear is provided, wherein the lifting gear is mounted in the stripping arm and on the stripping tower and the lifting gear has at least one load cell.

The designs of lifting gear known from the prior art include a connection to the stripping tower and are usually secured in a stationary mount on the stripping arm. A load on the lifting gear may also be reduced by using energy storage devices or counterweights. For example, a portion of the weight of the stripping arm is secured by means of a counterweight, so that only a small portion of the total weight of the stripping arm need be moved by the lifting gear. Stripping arms contain the stripping element, which is usually one or more stripping rollers with the respective drive units, which result in a total weight of the stripping arm of more than 500 kg, even with smaller systems. Lifting gears such as chain or belt drives, threaded spindle drives or toothed rod drives have one or more mounting points on the stripping tower and on the stripping arm. One or more load cells are inserted at these fastening points so that the fastening of the lifting gear to the stripping tower is accomplished by including the load cells. It is irrelevant where the load cells are provided in the lifting gear, as long as at least a portion of the weight of the stripping arm to be moved by the lifting gear is detected by the load cells.

The load cell is preferably arranged in the lifting gear in such a way that only a single load cell is necessary. To do so, the load cell is to be integrated into the mounting of the lifting gear on the stripping arm or in the stripping tower. This therefore yields a fastening of the lifting gear on the stripping arm or on the stripping tower by means of a load cell, where the load cell forms the connecting element between the lifting gear and the fastening point. However, in this case the load cell is also to be assigned to the lifting gear and is not a component of the stripping arm or the stripping tower.

Various designs of so-called force pickups may be used in the load cells. For example, the use of force pickups, in which the force acts on an elastic spring body and deforms it, is known. The deformation of the spring body is converted by strain gauges, whose electric resistance changes with the strain, into a change in electric voltage. The electric voltage and thus the change in strain are recorded by a measurement amplifier. These parameters can be converted into a measured force value based on the elastic properties of the spring body. Spring bodies that may be used include bending bars, ring torsion springs or other designs. Piezoceramic elements are used in another load cell model. Then microscopic dipoles are formed within the elementary cells of the piezoelectric crystal due to the directional deformation of a piezoelectric material. Adding these up over the electric field associated with this in all the elementary cells of the crystal results in a macroscopically measurable electric voltage, which can be converted into a measured force value. Load cells are known in the prior art and are widely used today in the measurement of force and weight.

Due to the use of a load cell, it is possible to move the stripping tower over the surface of the fiber bale with a certain pressure. A bearing force of the stripping arm on the fiber bale can be determined by means of the load cell. The stripping element provided in the stripping arm is lowered down to the surface of the fiber bale until a certain release of the load is detected by means of the load cell. The release of the load corresponds to the bearing force with which the stripping element provided in the stripping arm is pressed against the surface of the fiber bale. The pressure with which the stripping element is pressed against the fiber bale, the properties and working speed of the stripping element and the speed of movement of the stripping tower with which the stripping arm is guided over the fiber bale essentially determine the amount stripped. It is now possible to directly influence the amount stripped by the bale opener by means of a direct measurement of the bearing force and the control of the lifting gear of the stripping arm associated therewith. The fiber bales are not stripped uniformly by the stripping process, so there are differences in height between the individual fiber bales or also within fiber bales. Then if the level of a fiber bale surface increases, the bearing force also increases. This is recorded by the load cell as an increased load relief and the control can respond through an appropriate lifting of the stripping arm.

Load cells can pick up and measure the force in only one specific direction. Any transverse forces that might occur should therefore be prevented. The stripping arm is therefore to be held in its guide on the stripping tower, so that all the transverse forces and tilting moments that derive from the cantilevered arrangement of the stripping arm are picked up by this guide. The guide of the stripping arm in the stripping tower is designed so that the lifting gear is subjected to loads with forces in the direction of movement of the stripping arm relative to the stripping tower. The guidance may be designed by guide rails mounted in the stripping tower and guide rollers provided in the stripping arm, for example.

If the lifting gear consists of a chain pulley, such a guide for the stripping arm was also necessary in the past because, due to the design, the chain itself could not absorb any transverse forces. According to the invention, for example, the deflection pulley guiding the chain is mounted on the stripping arm by way of a load cell. However, it is also conceivable for a load cell to be integrated into the fastening of the chain and the stripping arm or into the chain guide itself. If a threaded spindle drive has been used as a lifting gear in the past, according to the invention the threaded spindle is to be suspended on the stripping tower by means of load cells or the spindle nut belonging to the threaded spindle is to be attached to the stripping arm via a load cell. The situation is similar when the threaded spindle is attached to the stripping arm. When using a plurality of threaded spindles, a plurality of load cells is also used accordingly. For example, if the stripping arm is not suspended on the threaded spindles but instead is placed on a plurality of threaded spindles or lifting gear of a different design (for example, hydraulic lifting gears), then the lifting gear may also be supported on load cells. The stripping arm is preferably suspended from the load cell by way of the lifting gear or is attached to the load cell, so that it is freestanding. It is advantageous to provide a cantilevered design because only forces in a certain direction can therefore be measured by the load cell. The connection of the load cell is free of transverse forces that would falsify the measurement results.

The lifting gear is preferably designed as in a ball screw drive. Ball screw drives have the advantage in comparison with threaded spindle drives that a lower driving power is necessary due to the point contact of the balls, which results in more accurate positionability. The ball screw drive can be adjusted almost without any clearance and therefore permits an accurate execution of even the smallest movements of the stripping arm in the direction of the longitudinal axis of the lifting spindle.

In the embodiment of a ball screw drive, the stripping arm is connected to the lifting spindle by means of a ball nut. Therefore, a ball screw drive is derived from the combination of the ball nut with the lifting spindle. Balls move in grooves which travel axially in rotation between the lifting spindle and the nut. A return channel in the ball nut conveys the balls back again and then closes the circulation in which the balls were circulating.

It is particularly advantageous if the fastening of the lifting spindle via a load cell on the stripping tower is provided only at an upper end of the lifting spindle and the lifting spindle is not held in the stripping tower or guided there at its lower end. Due to this type of fastening of the lifting spindle, which is equivalent to being suspended, this yields a further reduction in the frictional forces inside the ball screw drive. Clamping of the lifting spindle by means of an upper and lower fastening can lead to imprecise movements of the ball nut because of temperature differences or stresses that occur within the lifting spindle.

The lifting spindle is preferably held in a rotationally fixed manner in the load cell in the stripping tower, and the ball nut is provided with a drive. The ball nut which creates a connection between the stripping arm and the lifting spindle is set in rotation by a drive and induces a movement of the stripping arm in the direction of the longitudinal axis of the lifting spindle.

BRIEF DESCRIPTION OF THE DRAWINGS

The invention will be explained in greater detail below on the basis of exemplary embodiments and illustrated by drawings in which.

DETAILED DESCRIPTION

Figure 1:
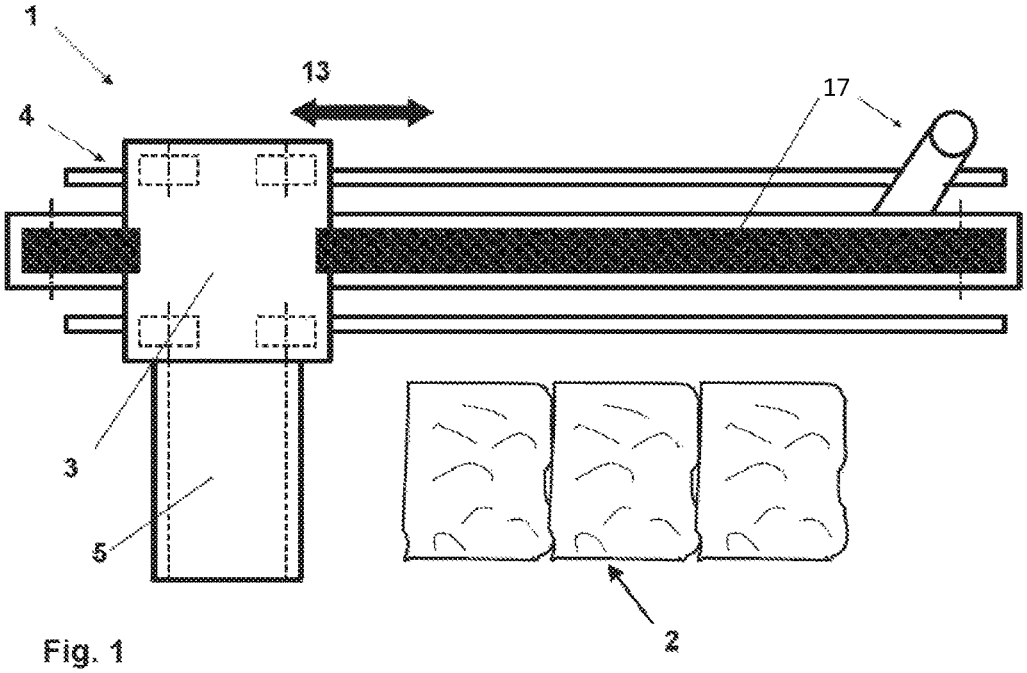
FIG. 1 shows a schematic diagram of a bale opener in a view from above.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
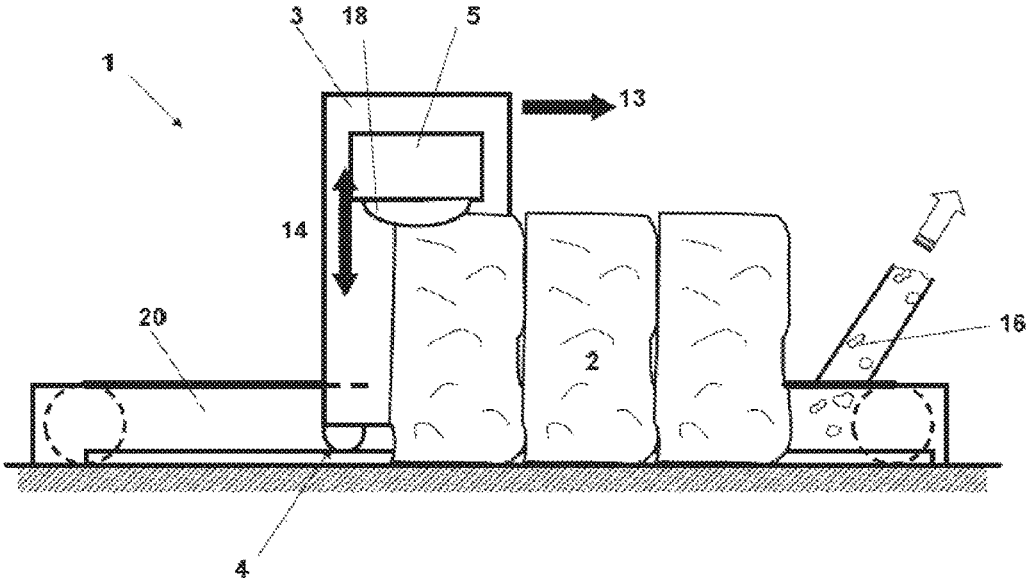
FIG. 2 shows a schematic diagram of a bale opener in a view from the front.

In schematic diagrams, FIG. 1 and FIG. 2 show a bale opener 1 for stripping fiber flocks from fiber bales 2, FIG. 1 shows the bale opener 1 in a view from above and FIG. 2 shows it in a view from the front. The bale opener 1 consists essentially of a stripping tower 3 and stripping arm 5. The stripping arm 5 is mounted on the stripping tower 3 at one end and is cantilevered freely over the fiber bale 2. The stripping tower 3 is furnished with a running gear 4. With the help of the running gear 4, the stripping tower 3 is moved on rails along the fiber bale 2. As a result of this movement 13, the stripping arm 5 mounted on the stripping tower 3 is guided over the surface of the fiber bales 2. A stripping element 15 is arranged in the stripping arm 5. The stripping element 15 pulls fiber flakes 16 out of the fiber bale 2. The fiber flocks 16 are brought by the stripping arm 5 and the stripping tower 3 to a pneumatic fiber flock transport system 17. The fiber flock transport system 17 and thus also the transport path from the stripping roller 15 to the fiber flock transport system 17 are under a certain vacuum which serves to pneumatically convey the fiber blocks 16 from the stripping element 15 through the fiber flock transport system 17.

The mounting of the stripping arm 5 on the stripping tower 3 is designed to be adjustable in height, so that the fiber bales 2 can be stripped continuously. The movement 14 of the stripping arm 5 serves to ensure a uniform stripping of the fiber flocks 16 from the surface of the fiber bales 2.

Figure 3:
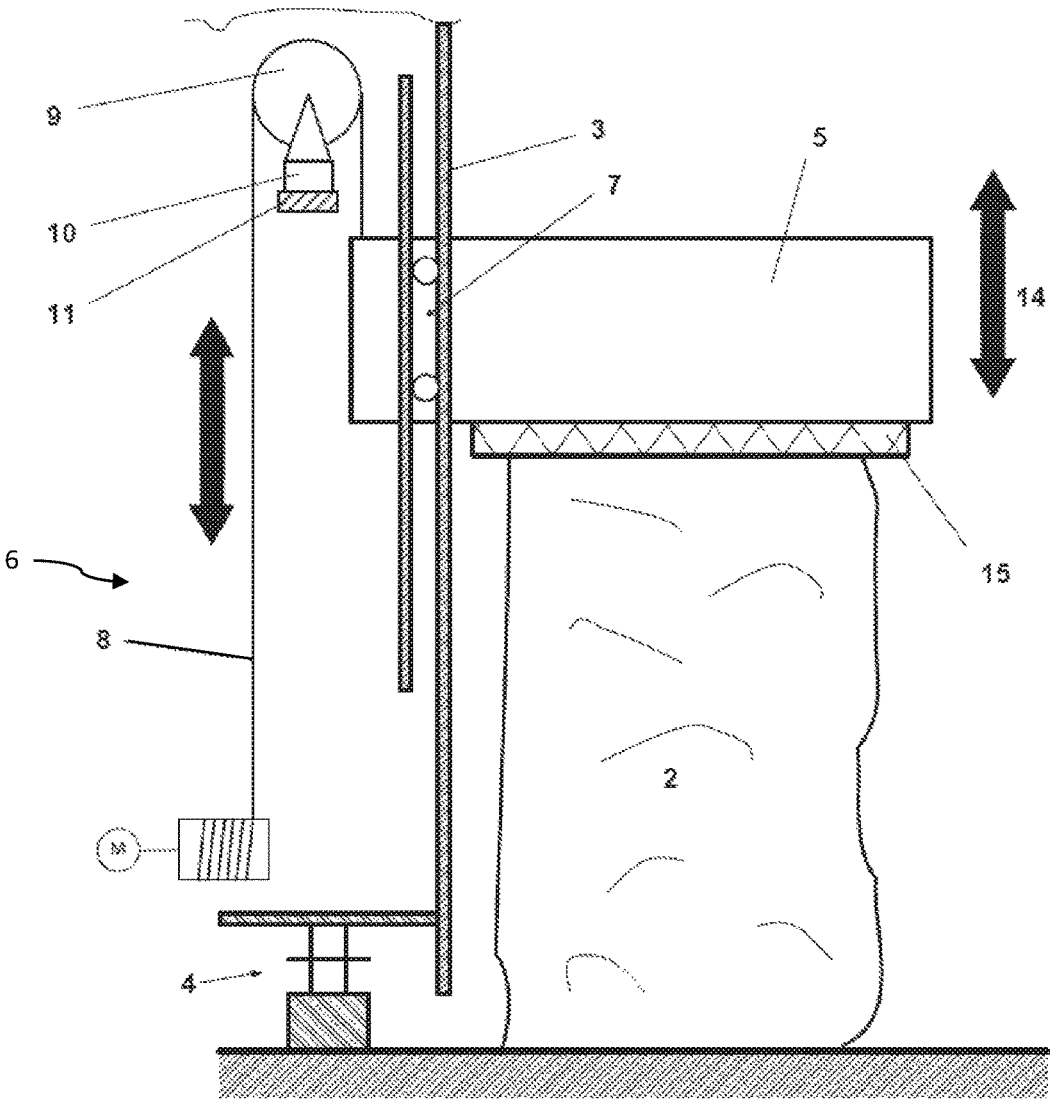
FIG. 3 shows a schematic sectional diagram A-A according to FIG. 2 of a first exemplary embodiment.

FIG. 3 shows a schematic view of a first embodiment in a sectional diagram A-A according to FIG. 2. On the basis of FIG. 3, the principle of the weight measurement or force measurement will be demonstrated. The diagram of the individual components as well as their arrangement is given as an example. The stripping arm 5 rests on the fiber bale 2 together with the stripping element 15 in the diagram shown here and is therefore in the stripping position. The stripping tower 3 is shown only in part and is standing on a running gear 4, with the help of which it is guided past the fiber bale 2. The stripping tower 5 is mounted so that it is cantilevered freely in a height-adjustable mount over a guide 7 in the stripping tower 3. The guide 7 is designed so that the stripping arm 5 can execute a vertical movement 14.

The lifting gear 6 for the movement 14 of the stripping arm 5 is designed as a chain drive. A chain 8, which is guided over a chain wheel 9 to the chain drive is secured on the stripping arm 5. The chain wheel 9 is mounted on a support 11 in the stripping tower 3. A load cell 10 is provided between the support 11 and the chain wheel 9. With the help of the load cell 10, the weight of the stripping arm 5 suspended on the chain 8 is measured. The same or similar construction is also possible with a belt drive.

Figure 4:
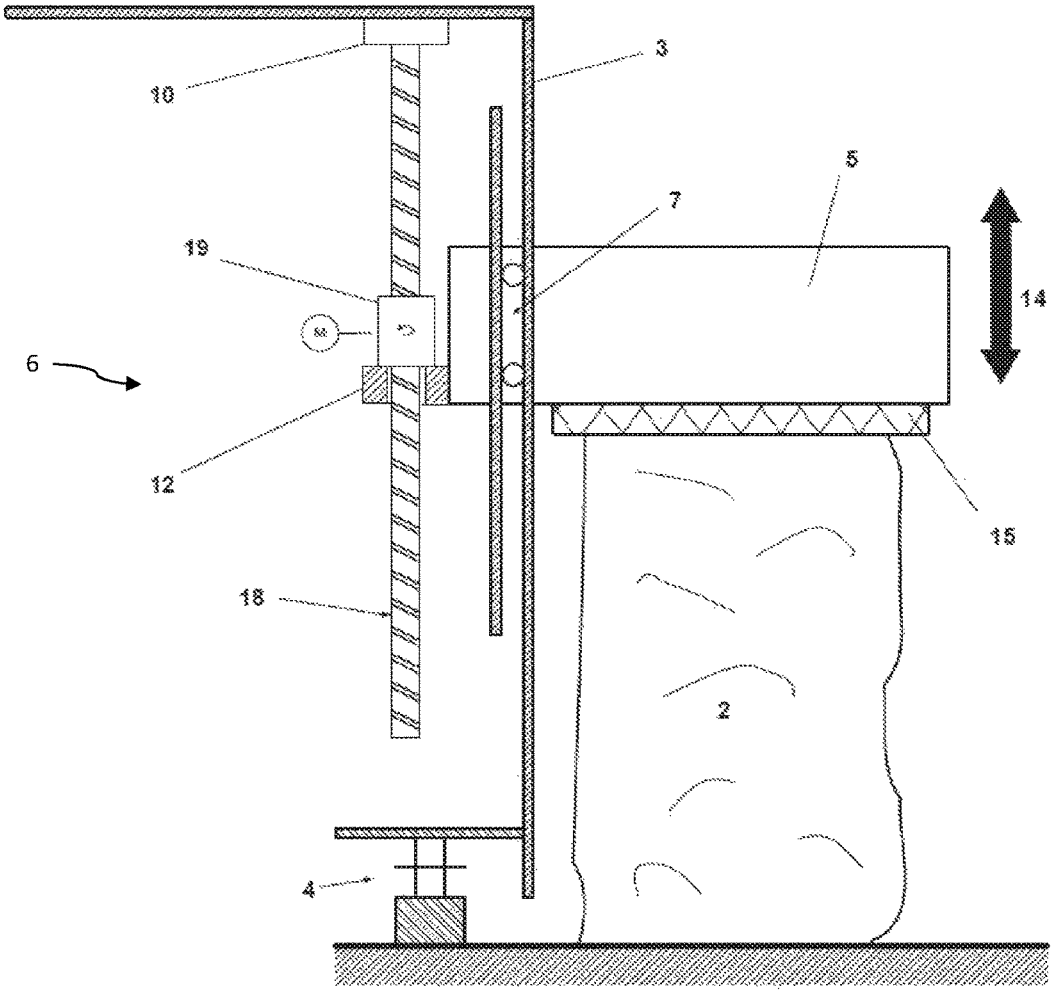
FIG. 4 shows a schematic sectional diagram A-A according to FIG. 2 of a second exemplary embodiment.

FIG. 4 shows a schematic view of a second embodiment in a sectional diagram A-A according to FIG. 2. The stripping arm 5 together with the stripping element 15 rests on the fiber bale 2 in the diagram shown here and is thus in the stripping position. The stripping tower 3 is shown only in part and rests on a running gear 4 with the help of which it is guided past the fiber bale 2. The stripping arm 5 is held in a freely cantilevered manner on the stripping tower 3 by means of the guide 7. The guide 7 is designed so that the stripping arm 5 can execute a vertical movement 14.

The lifting spindle 18, which is surrounded by a ball nut 19, passes through the stripping arm 5. The ball nut 19 together with its housing is held in a fixed position in the mount 12 on the stripping arm 5. The ball nut 19 is connected to a drive mounted in the stripping arm 5. The drive induces rotation of the ball nut 19 which leads to a lifting or lowering of the stripping arm 5, depending on the direction of rotation. The guide 7 holds the stripping arm 5 on a predefined path so that the ball nut 19 together with the stripping arm 5 runs along the lifting spindle 18 and thus executes the vertical movement 14. The lifting spindle 18 is attached at its upper end to a load cell 10 in a rotationally fixed manner so that the load cell 10 is in turn held on the stripping tower 3. The lifting spindle 18 is suspended in the load cell 10 so that no lower securing or fastening of the lifting spindle 18 is necessary.

Modifications and variations can be made to the embodiments illustrated or described herein without departing from the scope and spirit of the invention as set forth in the appended claims.

LEGEND

1 bale opener
2 fiber bale(s)
3 stripping tower
4 running gear
5 stripping arm
6 lifting gear
7 guide
8 chain
9 chain wheel
10 load cell
11 support
12 mount
13 movement of stripping tower
14 movement of stripping arm
15 stripping element
16 fiber flocks
17 fiber flock transport system
18 lifting spindle
19 ball nut

The invention claimed is:

1. A bale opener for stripping fiber flocks from fiber bales, comprising:

a stripping tower arranged on one of a running gear or a bogie;

a stripping arm mounted in a height-adjustable and cantilevered manner in a guide on the stripping tower;

a lifting gear mounted on the stripping arm and configured with the stripping tower to provide for height adjustment of the stripping arm relative to the stripping tower; and a load cell integrated into the lifting gear at a location to detect a bearing force exerted by the stripping arm on the fiber bales.

2. The bale opener according to claim 1, wherein the load cell is integrated into one of (a) a mounting of the lifting gear on the stripping arm such that the stripping arm is free standing on the load cell, or (b) a mounting of the lifting gear on the stripping tower such that that the stripping arm bears on the load cell through the lifting gear mounting on the stripping tower.

3. The bale opener according to claim 1, wherein the lifting gear comprises a chain drive or a belt drive.

4. The bale opener according to claim 1, wherein the lifting gear comprises a toothed rod.

5. The bale opener according to claim 1, wherein the lifting gear comprises a threaded spindle drive.

6. The bale opener according to claim 1, wherein the lifting gear comprises a ball screw drive.

7. The bale opener according to claim 1, wherein the guide is configured such that the lifting gear is loaded with forces in only the height adjustment direction of movement of the stripping arm relative to the stripping tower.

8. The bale opener according to claim 1, wherein the load cell determines a bearing force of the stripping arm acting on the fiber bale.

* * * * *